US008146779B2

(12) United States Patent
Bromber

(10) Patent No.: US 8,146,779 B2
(45) Date of Patent: Apr. 3, 2012

(54) SELF-ORIENTING AEROSOL APPARATUS AND METHOD OF CLEANING A TRASH CAN

(76) Inventor: Kevin Bromber, Tarzana, CA (US)

( * ) Notice: Subject to any disclaimer, the term of this patent is extended or adjusted under 35 U.S.C. 154(b) by 193 days.

(21) Appl. No.: 12/723,541

(22) Filed: Mar. 12, 2010

(65) Prior Publication Data

US 2010/0166598 A1 Jul. 1, 2010

Related U.S. Application Data

(62) Division of application No. 11/125,799, filed on May 10, 2005, now Pat. No. 7,708,173.

(60) Provisional application No. 60/607,703, filed on Sep. 8, 2004.

(51) Int. Cl.
*B67B 7/00* (2006.01)
*B67D 7/84* (2010.01)
*B65D 25/00* (2006.01)

(52) U.S. Cl. ..... 222/1; 222/402.13; 222/463; 220/87.2; 220/908.2

(58) Field of Classification Search ..... 222/1, 402.13, 222/402.15, 402.23, 402.22, 402.12, 402.11, 222/402.1, 182, 373, 378, 372, 402.14, 160, 222/173, 463, 137, 184, 464.1, 464.4, 4, 222/64.5; 220/87.1, 87.2, 908.2; 206/205, 206/213.1

See application file for complete search history.

(56) References Cited

U.S. PATENT DOCUMENTS 2,998,165 A 8/1961 De Elorza
3,058,626 A * 10/1962 Hibbs et al. ..... 222/182
3,185,349 A * 5/1965 Sagarin ..... 222/153.05
3,228,565 A 1/1966 Stanzel
3,610,479 A * 10/1971 Venus, Jr. ..... 222/402.13
3,756,472 A 9/1973 Vos
3,804,302 A 4/1974 Yamada et al.
3,935,974 A 2/1976 Weyn
4,277,004 A 7/1981 Barlics
5,209,380 A 5/1993 Williams
5,279,444 A 1/1994 Williams
6,113,008 A 9/2000 Arsenault et al.
6,161,736 A * 12/2000 Kaufman et al. ..... 222/402.13
6,454,139 B1 * 9/2002 Bayer ..... 222/645
6,971,560 B1 * 12/2005 Healy et al. ..... 222/645
7,056,179 B2 6/2006 Courtney
7,104,427 B2 * 9/2006 Pericard et al. ..... 222/402.13
2003/0127468 A1 7/2003 Loghman-Adham et al.
2003/0168476 A1 * 9/2003 Sanchez ..... 222/321.7
2004/0256417 A1 * 12/2004 Mather et al. ..... 222/402.13

* cited by examiner

*Primary Examiner* — Kevin P Shaver
*Assistant Examiner* — Stephanie E Williams
(74) *Attorney, Agent, or Firm* — Pillsbury Winthrop Shaw Pittman LLP

(57) ABSTRACT

An orienting skirt joined to an aerosol can, the orienting skirt having a generally arcuate rim extending outward such that when the can is placed on a flat surface, the rim urges the can into a predetermined generally stable horizontal configuration with the discharge nozzle oriented in an upright direction. A full release actuator is disposed adjacent to the valve stem of the aerosol can and has a trigger and a discharge nozzle such that when the trigger is pressed the contents of the aerosol can are dispensed through the discharge nozzle. With the discharge nozzle in an upright direction, the contents of the can are dispersed more evenly on the interior surfaces of the trash can.

3 Claims, 5 Drawing Sheets

SELF-ORIENTING AEROSOL APPARATUS AND METHOD OF CLEANING A TRASH CAN

CROSS-REFERENCE TO RELATED APPLICATION

This application is a divisional of U.S. patent application Ser. No. 11/125,799, filed May 10, 2005 now U.S. Pat. No. 7,708,173, which is based upon and claims priority under 35 U.S.C. §119(e) to U.S. provisional patent application Ser. No. 60/607,703 filed Sep. 8, 2004, the contents of which are incorporated herein by reference.

BACKGROUND

This invention relates generally to the field of aerosol actuators and overcaps, and more specifically to a self-orienting aerosol apparatus.

The need to effectively combat odor and germs in outdoor trash cans is well established. Outdoor trash cans are often located close to residences and businesses, where odors can be problematic and disruptive. Odors emanating from trash cans attract rodents and other animals that scatter garbage and pose the risk of transmitting diseases. If untreated, the germs inside trash cans can pose health risks to those who come into contact with the trash or trash cans.

Various kinds of vapor-dispensing devices have been employed for the general purpose of deodorizing and sanitizing air. One type of dispensing device is a dish containing or supporting a body of gelatinous matter which dries and shrinks, releasing a vaporized air-treating composition. Other products such as deodorant blocks and liquid wicks are also used for dispensing air-treating vapors into the atmosphere by evaporation. Another group of vapor-dispensing device utilizes a carrier material such as paperboard impregnated or coated with a vaporizable composition. These vapor-dispensing devices are available in the form of stick-on type fresheners, which attach to the inside of a trash can.

One disadvantage of vapor dispensing devices such as gelatinous air fresheners, deodorant blocks, and liquid wicks is that they only mask odors instead of sanitizing the air. In addition, stick-on type fresheners require the consumer to touch the inside of the trash can and are easily knocked off by incoming trash. Scouring trash cans with a brush, hose, and detergent can be effective, but is time consuming and messy.

The most common dispensing device for deodorizing and sanitizing is the aerosol can. The aerosol can propels minute droplets of an air freshener composition into the air or onto a surface. The contents of the aerosol can are typically released by pressing an actuator. A standard hand-held aerosol actuator requires a user to manually hold down the actuator and point it at the desired area of application. When cleaning a trash can, this requires the individual to hold the aerosol can and lean into a trash can for an extended period of time to ensure adequate coverage of the interior walls, floor, and roof of the trash can.

Another actuator design is the total release actuator, commonly found on insecticide foggers. The total release actuator releases all of an aerosol can's contents by locking the actuator button in place and requiring the user to place the aerosol can in an upright position. However, a total release actuator is useful only if the individual can place the aerosol can on a flat surface. This is normally not possible inside a trash can, especially an outdoor or industrial dumpster, since the depth of the container exceeds a person's reach. Furthermore, existing total release actuators would spray directly upwards and into the face if placed from the top down.

It is therefore desirable that the interior of a trash can be sanitized and deodorized by a self-orienting aerosol spray that eliminates the need to reach into the can to ensure that the walls, floor, and roof are properly treated.

Information relevant to attempts to address this problem can be found in U.S. Pat. Nos. 5,791,524, 6,820,823, 4,197,915, 6,581,539, 6,457,604, 3,785,569. However, each of these references suffers from one or more of the following disadvantages: lack of a mechanism for self-orienting the apparatus when dropped into a trash can, inability to discharge contents when in a horizontal configuration, and lack of interoperability with a standard aerosol can.

SUMMARY

The present invention is directed to a self-orienting aerosol apparatus that eliminates the need to reach into a trash can to ensure that the walls, floor, and roof are properly treated. An aerosol can used in the present invention has, preferably, a valve effective to discharge substantially all of the contents of the aerosol can through a valve stem. A full release actuator (also known as a "total release actuator") is disposed adjacent to the valve stem of the aerosol can and has a trigger and a discharge nozzle such that when the trigger is pressed, the contents of the aerosol can are dispensed through the discharge nozzle. An orienting skirt is joined to the can, the orienting skirt having a generally arcuate rim extending outward such that when the can is placed on a flat surface, the rim urges the can into a predetermined generally stable configuration, with the discharge nozzle oriented in an upright direction. With the discharge nozzle in an upright direction, the contents of the can may be dispersed more evenly throughout the interior of the trash can, reducing concentration of the can's contents on the floor or walls of the trash can.

DRAWINGS

These and other features of the present invention may be better understood with reference to the drawings.

FIG. 1 shows the self-orienting aerosol apparatus in its entirety.

FIGS. 2*a*-2*e* shows views of the skirt and release actuator.

DETAILED DESCRIPTION OF THE INVENTION

Figure 1:
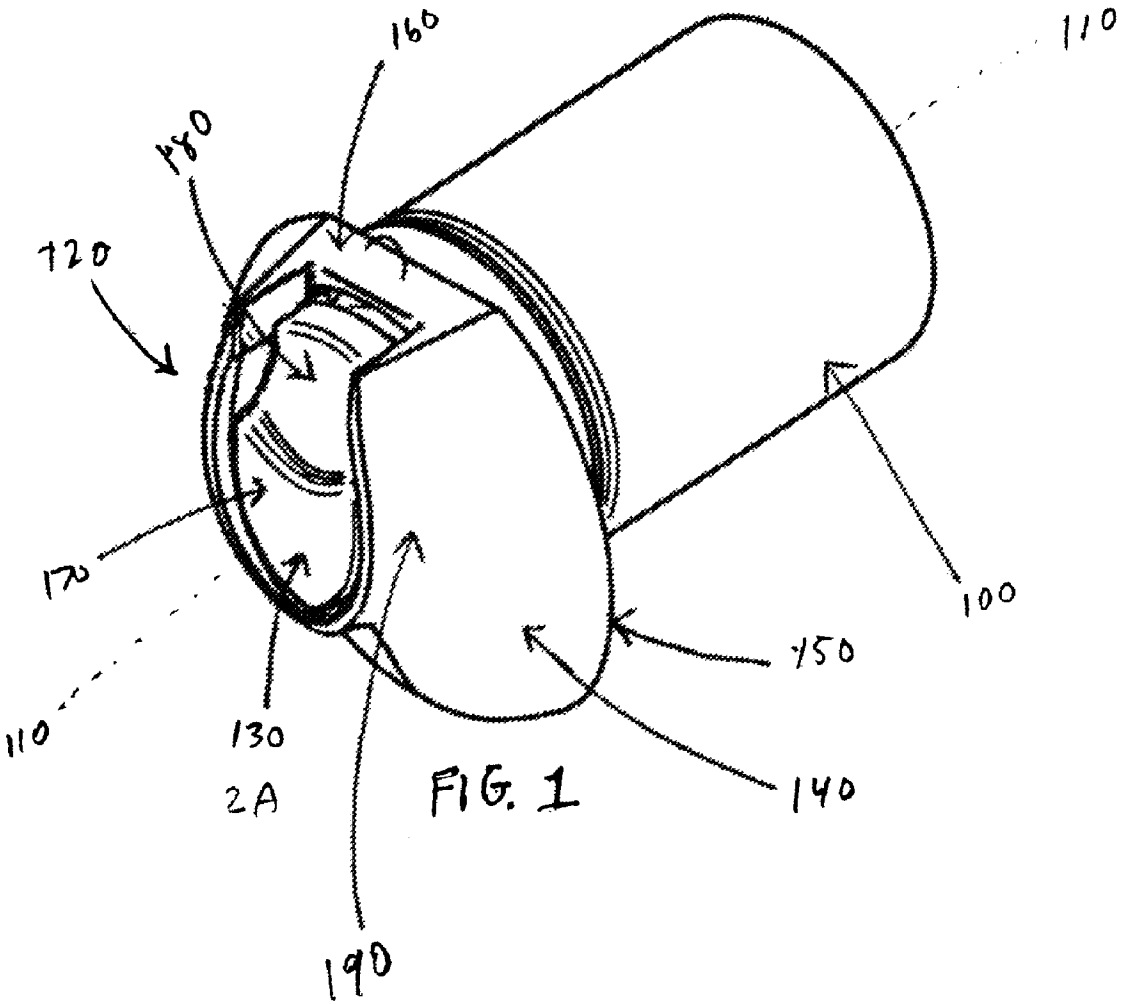
Figure 2B:
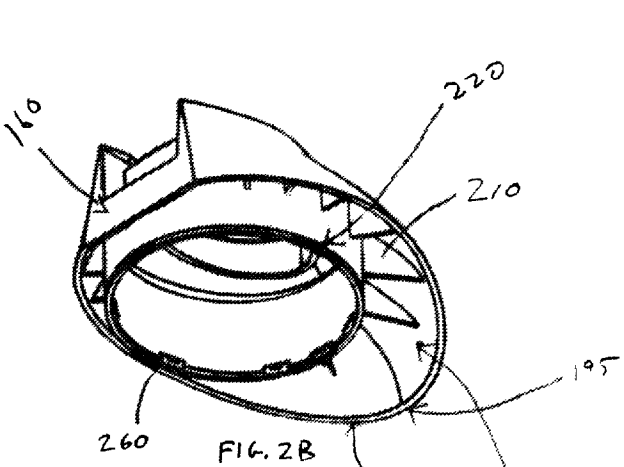
Figure 2D:
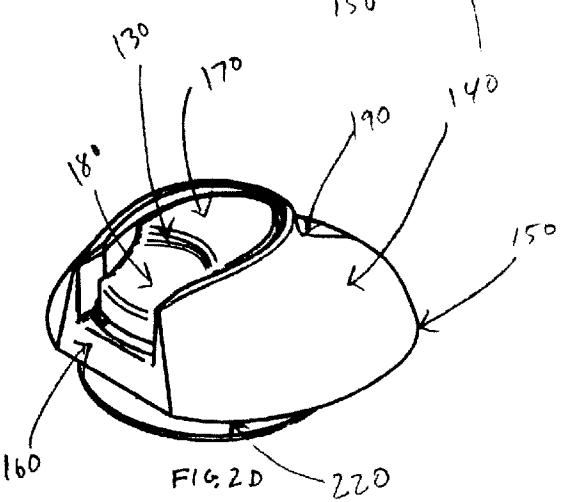
Figure 2A:
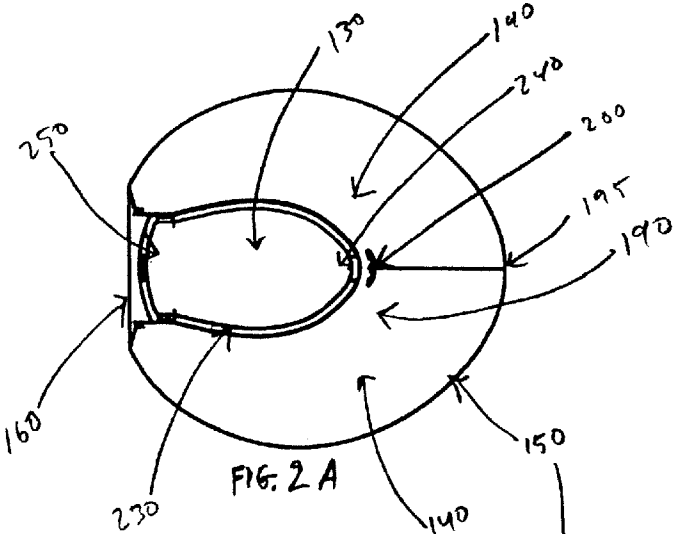
Figure 2C:
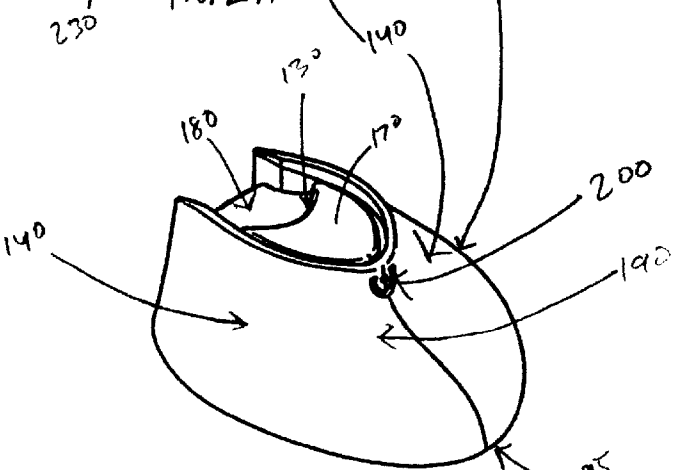
Figure 2E:
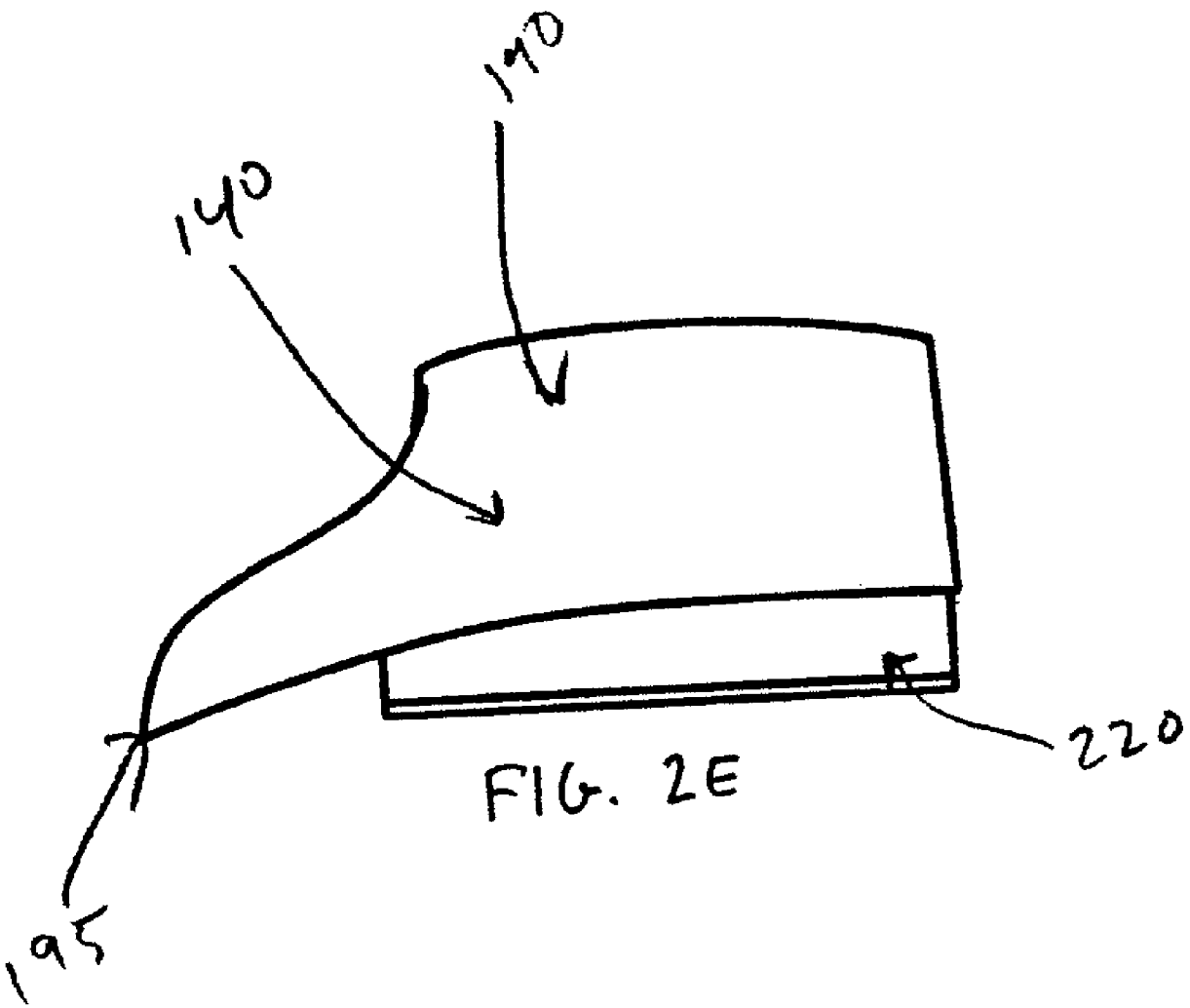

FIG. 1 shows the self-orienting aerosol apparatus, comprised of a can 100 having a rolling axis 110, a release actuator 120 disposed on an end of the can, and a skirt 140 surrounding the release actuator 120. The skirt has a rim 150 with a flattened side 160. The rim 150 provides a rolling surface for the apparatus about the rolling axis 110. Rolling motion about the rolling axis 110 is stabilized when the apparatus comes to rest on the flattened side 160. The skirt 140 and the actuator 120 may be of a unitary construction.

FIG. 2 shows several views of the release actuator 120 and skirt 140. The release actuator 120 is comprised of a trigger 130 and a discharge nozzle 200. The trigger 130 has an arcuate outer boundary 230, an apex 240 adjacent to the discharge nozzle 200, a wider end 250 adjacent to the flattened side 160, an upper step 170, and a lower step 180. The upper and lower steps provide an ergonomic surface for depressing the trigger 130. When depressed, the trigger 130 causes the contents of the can to be released through the discharge nozzle 200.

A joining means 220 joins the skirt 140 to the can 100. In the embodiment shown, the joining means 220 defines a ring 300 that receives the end of the can containing a valve stem 400. In one embodiment, disposed on the interior surface of the joining means 220 are hooks 260 that latch securely to the can such that the trigger 130 may be depressed and the contents of the can may be released without the can 100 becoming detached from the actuator 120.

Figure 3:
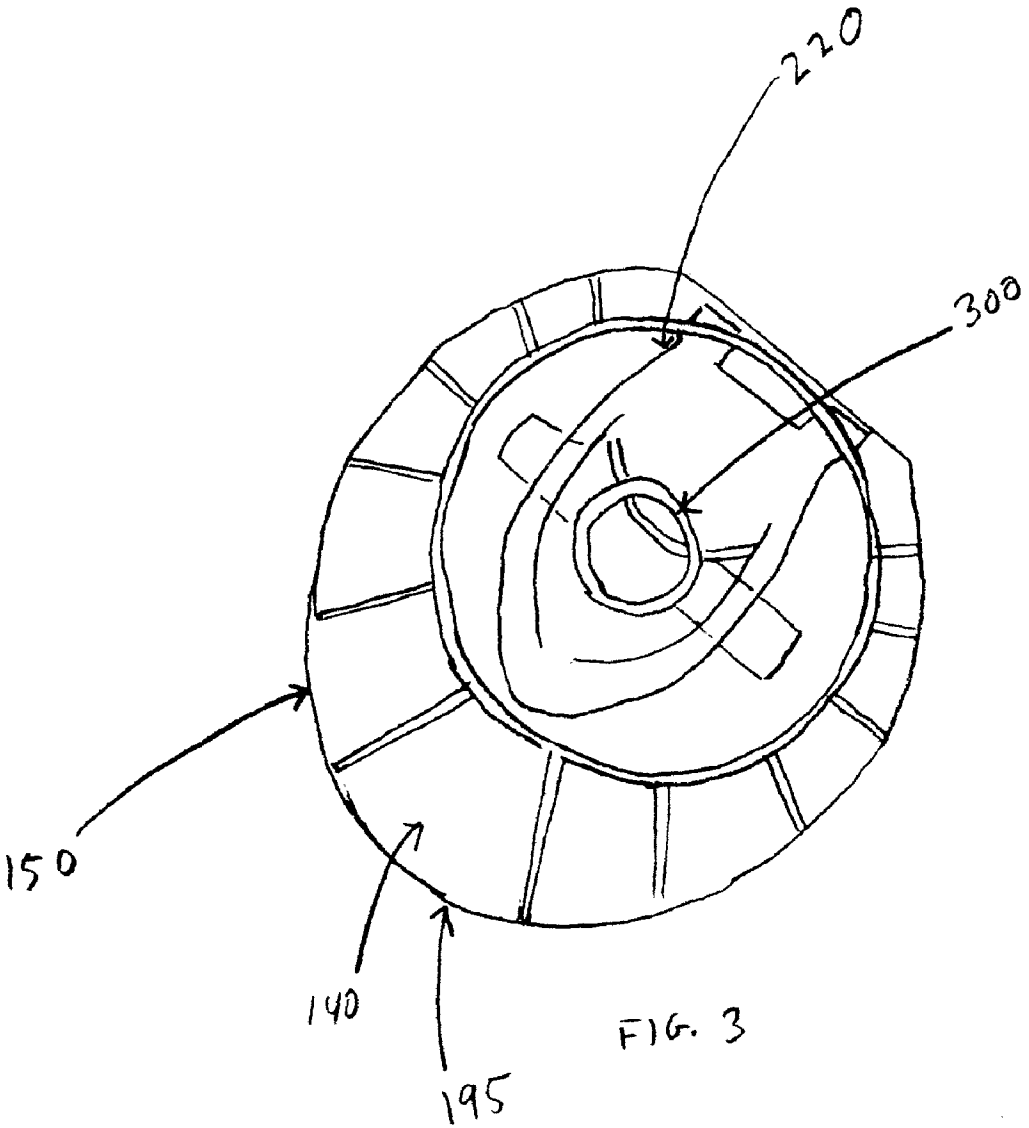
FIG. 3 shows a bottom view of the skirt and release actuator.

FIG. 3 shows a view of the joining means 220 and horizontal support ribs 210. To provide strength to the skirt 140, horizontal support ribs 210 are disposed beneath an upper surface 190 of the skirt 140 and extend in a radial direction. The ring 300 disposed on the interior of the joining means 220 on a plane parallel to the actuator 120 fits directly onto the valve stem 400 of the can 100.

Figure 4:
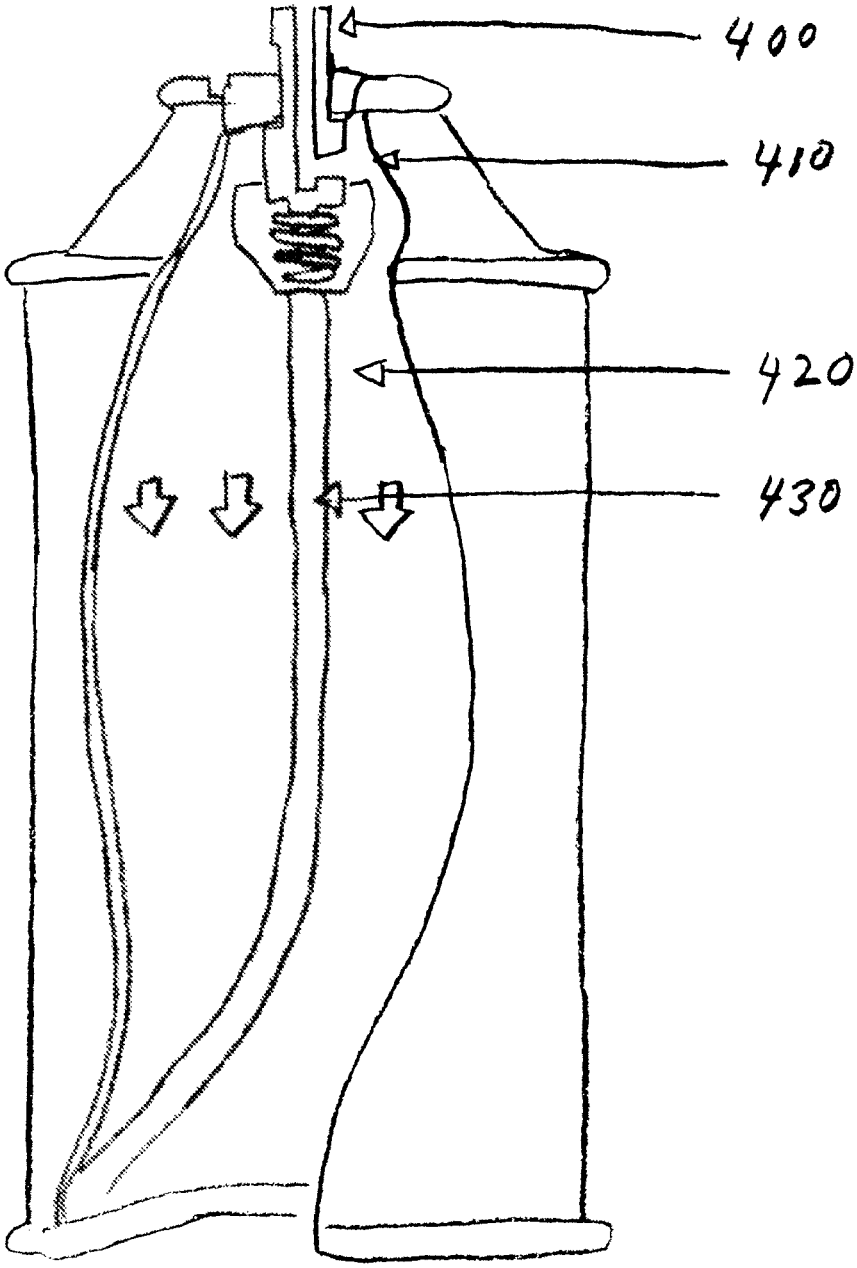
FIG. 4 PRIOR ART
FIG. 4 shows a prior art aerosol can detached from the skirt and release actuator.

FIG. 4. shows a standard aerosol can detached from the skirt 140 and release actuator 120. The aerosol can 100 is comprised of a valve stem 400 extending from an upper end the of the can 100, a valve 410 extending into the interior of the can 100 connected to an elongated tube 430, and a deodorizing agent 420 comprising the contents of the can 100.

The skirt 140 and release actuator 120 are secured to the can 100 by the joining means 220. The release actuator 120 is activated by means of depressing the trigger 130. When depressed, the trigger activates the valve 410, which causes the deodorizing agent 420 to enter the elongated tube 430. The deodorizing agent 420 then travels into the elongated tube 430, out of the valve stem 400, and exits through the discharge nozzle 200. Therefore, the position of the discharge nozzle 200 determines where the deodorizing agent 420 will be distributed.

When the actuator 120 is depressed and the deodorizing agent 420 begins to be released through the discharge nozzle 200, then the apparatus is placed on the floor of a trash can. The method of placing the apparatus on the floor of the trash can may vary. For example, the apparatus may be dropped from a height, placed directly on the floor, or dropped from a short distance above the floor if a person reaches into the trash can as far as possible before releasing the apparatus. Regardless of the method of placement or which area of the rim the can initially rests upon, the orienting skirt 140 and arcuate rim 150 urge the can into a predetermined generally stable configuration resting on the flattened side 160 of the rim 150, in a generally upright direction. Although each point on the rim 150 is a potential initial resting spot for the aerosol can 100, the curvature of the rim 150 and the higher center of gravity of the aerosol can 100 combine to create unstable configurations at all points along the curvature of the rim 150.

For example, the front 195 of the rim 150 is an unstable configuration because the center of gravity of the can 100 is at its highest point and the front 195 is a curved portion of the rim. In this configuration, the aerosol can 100 self-orients by rolling freely along the rim 150 until it comes to rest on the flattened side 160. This rolling motion is caused by the weight of the can itself, without the use of any external counterweights. Once on the flattened side 160, further motion of the aerosol can 100 is impeded and the aerosol can 100 is at its lowest possible center of gravity. In this equilibrium position, the discharge nozzle 200 is oriented in a generally upright direction and the apparatus is best positioned to discharge the contents of the can 100 in an upward direction, away from the bottom or sides of the trash can, to substantially treat the interior of the trash can.

The present invention requires that the valve 410 within the aerosol can 100 be effective to discharge the contents 420 while the aerosol can 100 lies on its side. Examples of existing valves that may be used in conjunction with the present invention include bag-on valves, weighted valves, piston valves, and 360 valves. The bag-on valve is a system providing a bag with a valve attached which is then placed inside an aerosol can 100. The bag and valve assembly is crimped in place and compressed air put around the outside of the bag. The contents are then injected through the valve into the bag, and the compression of the bag by the air forces the can 100 to discharge its contents 420. The bag-on valve has many advantages including continuous spraying under all angles, use with both liquid and viscous products, use with various can types, a quiet, non-chilling discharge, total integrity of the contents by hermetically sealing the product within the bag, and avoids contact between the contents and the propellant, making aerosol cans safe and non flammable.

Weighted valves contain a bushing attached to the tip of an elongated tube 430. The bushing provides weight so that the aerosol can 100 may be sprayed both in an upright and tilted position. Alternately, a ball wrapped with a ball holder may be attached to the tip of the elongated tube 430. This valve allows the aerosol can to be sprayed in an upright, tilted, or upside down position.

The piston valve, common with shaving gel products, contains a piston-type barrier that separates the contents of the can 100 from the propellant source. Unlike the traditional method of filling through the valve, piston containers require the charging of the propellant through an orifice in the bottom of the can. The can may be oriented in any direction and the contents will still be discharged as long as the actuator is being depressed.

Finally, the 360 valve, also called an up/down valve, permits the product to be used in an upright or inverted position. These various valves may be used in conjunction with the present invention to discharge the contents of the aerosol can while the can 100 is lying on its side.

The present invention therefore provides a way to deodorize and sanitize the interior of a trash can with an aerosol can without having to reach into the trash can to direct the spray or hold down the actuator while the contents of the aerosol can are discharged. This provides a clean, quick way to deodorize and sanitize a trash can to effectively fight odors, germs, and rodents or other animals attracted to the odor of trash. However, not all of the advantageous features or advantages need to be incorporated in every embodiment of the present invention.

Although the present invention has been described in considerable detail with reference to certain preferred embodiments, other embodiments are within the scope of this invention. For example, the skirt and actuator need not be of a unitary construction, but could be attached to separate positions of the aerosol can. The contents of the can may be any type of deodorizer or sanitizer, a combination of both, water, bug repellant, or any other composition that is effective to deodorize and sanitize or repel unwanted animals. The actuator in the preferred embodiment is made of plastic and has a flat side, but could be constructed of any material that is strong enough to withstand being dropped from a height into a trash can, and need not have a flat side provided that the can self-orients in a generally stable configuration such that the discharge nozzle is in a generally upright direction. The present invention describes a self-righting aerosol apparatus in the context of cleaning a trash can, but it may be used in any situation requiring an aerosol can to discharge its contents in a specific direction, regardless of the internal capacity of the aerosol can or the size of the canister in which it may be placed. Therefore, the spirit and scope of the appended claims should not be limited to the description of the preferred versions contained herein.

The invention claimed is:

1. A method of deodorizing a canister comprising the steps of:

(A) providing a deodorizing apparatus comprising:

an aerosol can containing a deodorizing agent, an actuator for releasing the contents of the aerosol can, and an orienting skirt for orienting the aerosol can such that the deodorizing agent may be dispersed evenly within the interior of the canister;

(B) activating the aerosol can such that the deodorizing agent begins to flow out of the can; and (C) placing the aerosol can inside a canister whereupon the orienting skirt urges the can into a stable horizontal position causing the deodorizing agent to exit the can and thereby substantially treat the interior of the canister with the agent.

2. The method of claim 1, where the canister is a trash bin.

3. The method of claim 1, wherein the activating the aerosol can is performed with one hand of a user, and the placing the aerosol can inside a canister is performed with another hand of the user.

* * * * *